US007766253B2

(12) United States Patent
Le Pesant et al.

(10) Patent No.: US 7,766,253 B2
(45) Date of Patent: Aug. 3, 2010

(54) NEBULIZER DEVICE AND METHOD WITH OVERPRESSURIZATION OF A LIQUID TO BE NEBULIZED

(75) Inventors: Jean-Pierre Le Pesant, Ventabren (FR); Hugues Brouard, Rochefort-Samson (FR)

(73) Assignee: Osmooze, Loriol sur Drome (FR)

( * ) Notice: Subject to any disclaimer, the term of this patent is extended or adjusted under 35 U.S.C. 154(b) by 209 days.

(21) Appl. No.: 11/741,304

(22) Filed: Apr. 27, 2007

(65) Prior Publication Data

US 2007/0262163 A1 Nov. 15, 2007

Related U.S. Application Data

(63) Continuation of application No. PCT/FR2005/002617, filed on Oct. 20, 2005.

(30) Foreign Application Priority Data

Oct. 29, 2004 (FR) ..... 04 11612

(51) Int. Cl.
*B05B 1/08* (2006.01)

(52) U.S. Cl. ..... 239/102.1; 239/67; 239/68; 239/102.2; 128/200.16; 128/200.23

(58) Field of Classification Search ..... 239/44, 239/67–70, 86, 102.1, 102.2, 145; 128/200.16, 128/200.23; 347/10, 27, 68, 70
See application file for complete search history.

(56) References Cited

U.S. PATENT DOCUMENTS 3,717,875 A * 2/1973 Arciprete et al. ..... 347/73
3,848,118 A * 11/1974 Rittberg ..... 239/101
5,511,726 A * 4/1996 Greenspan et al. ..... 239/102.2
6,460,980 B1 * 10/2002 Hegedus et al. ..... 347/68
6,712,287 B1 3/2004 Le Pesant et al.
2004/0099060 A1 * 5/2004 Kijlstra et al. ..... 73/714
2005/0172957 A1 * 8/2005 Childers et al. ..... 128/200.23

FOREIGN PATENT DOCUMENTS

EP 0714709 B1 6/2000
WO 96/31289 A1 10/1996

* cited by examiner

*Primary Examiner*—Len Tran
*Assistant Examiner*—Jason J Boeckmann
(74) *Attorney, Agent, or Firm*—Panitch Schwarze Belisario & Nadel LLP

(57) ABSTRACT

A device (30) for nebulizing a liquid includes a nebulization head (40) having a capillary tube (40-1) and a nozzle (40-2) for ejecting a liquid (43), a liquid supply tank (42) for supplying the nebulization head with liquid (43), a vibrator (44) for vibration driving the nebulization head so that it ejects droplets of liquid in a nebulization jet. The device (30) further includes a pressure regulator for applying to the liquid at the inlet to the nebulization head (40), during nebulization cycles, a pressure greater than a first pressure threshold above which the liquid flows through the nebulization head when the head is not vibration driven, and lower than a second pressure threshold above which the liquid flows through the nebulization head when the head is vibration driven. Advantages of the device include increase in the nebulization flow rate and low sensitivity to changes in trim and to vibrations.

15 Claims, 3 Drawing Sheets

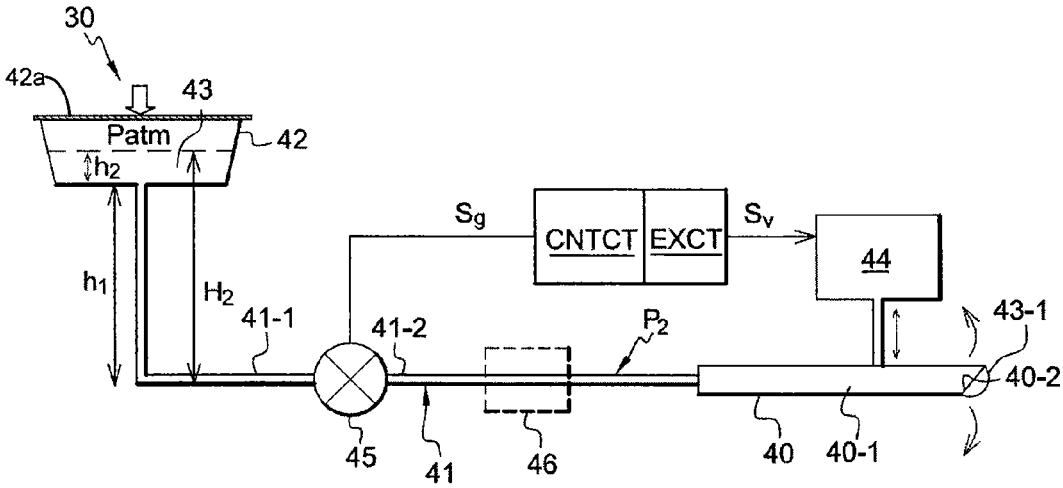
Fig. 3
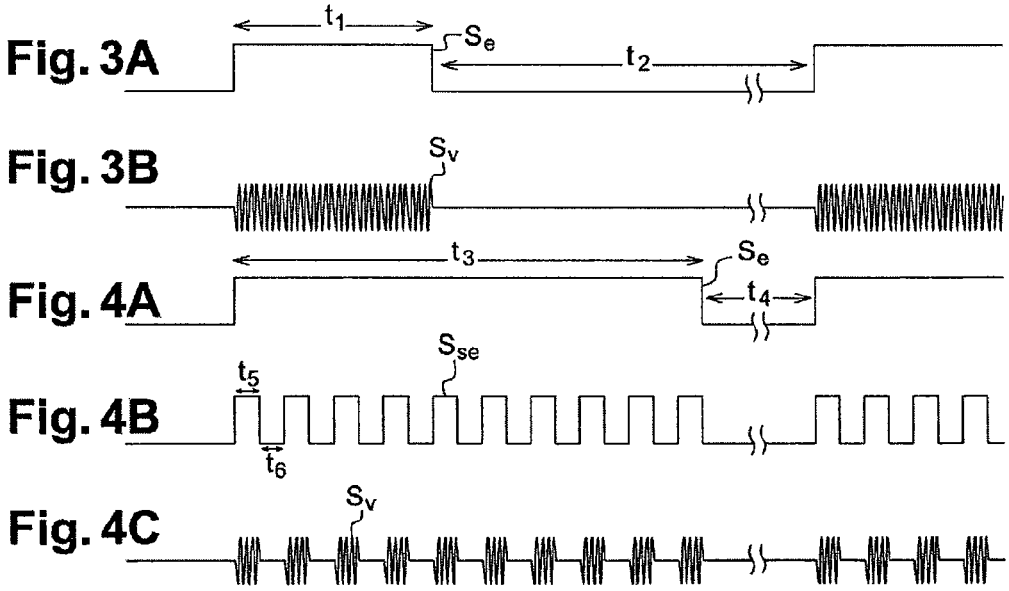

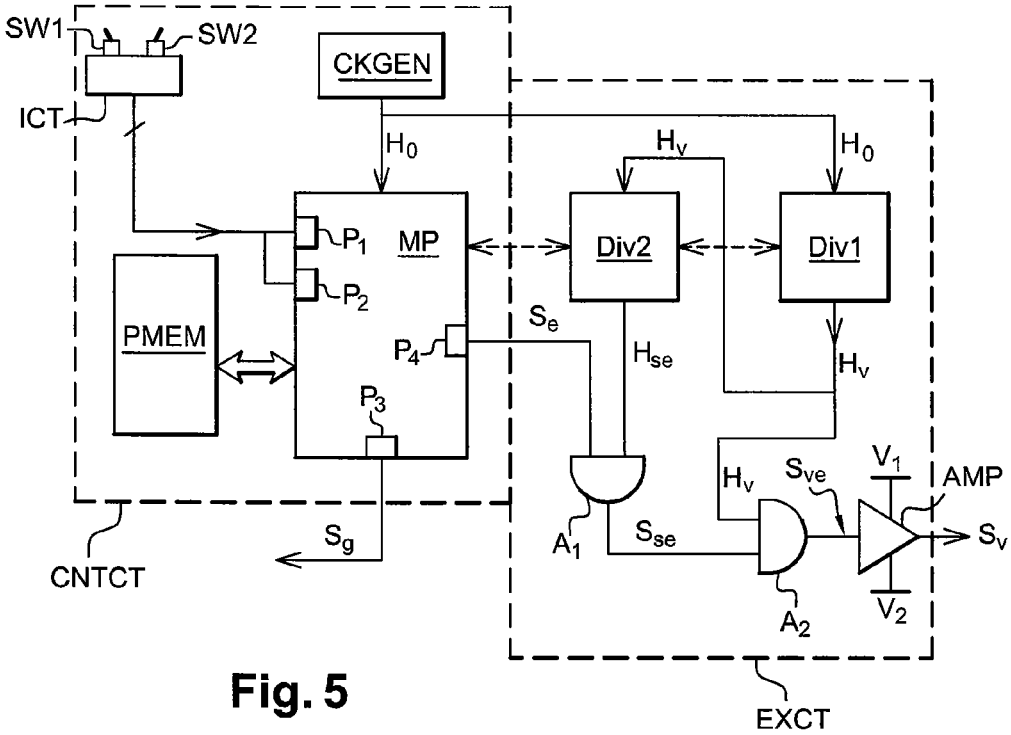
Fig. 5
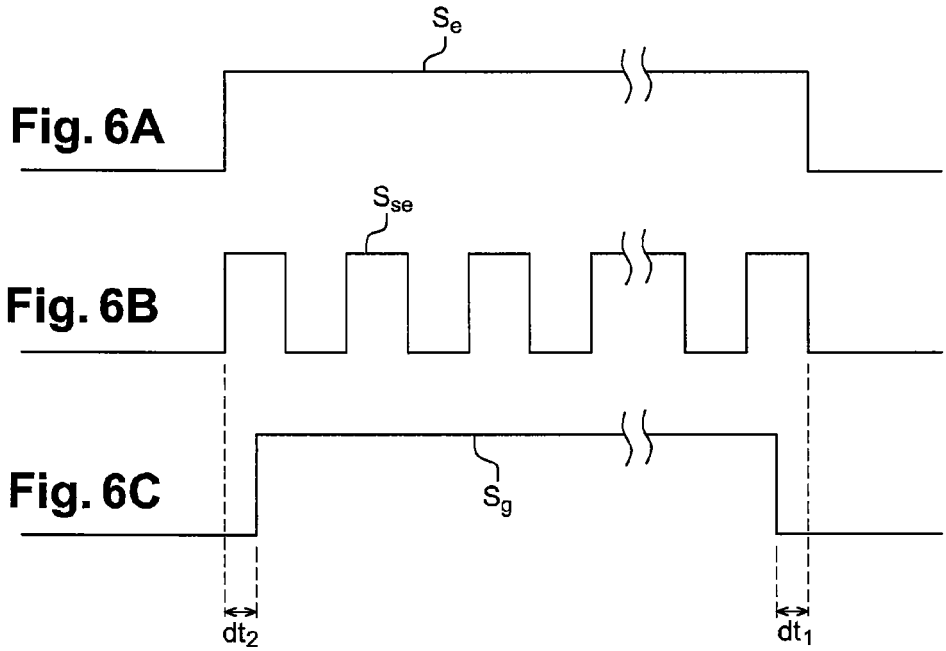

NEBULIZER DEVICE AND METHOD WITH OVERPRESSURIZATION OF A LIQUID TO BE NEBULIZED

CROSS-REFERENCE TO RELATED APPLICATIONS

This application is a Continuation of International Application No. PCT/FR2005/002617, filed Oct. 20, 2005, which was published in the French language on May 11, 2006, under International Publication No. WO 2006/048523 A1 and the disclosure of which is incorporated herein by reference.

BACKGROUND OF THE INVENTION

The present invention relates to a device for nebulizing a liquid, comprising a nebulization head having a capillary tube and a nozzle for ejecting a liquid, a liquid supply tank for supplying the nebulization head with liquid, linked to the nebulization head by a pipe, a vibrator for vibration driving the nebulization head, so that it ejects droplets of a liquid in a nebulization jet, and an exciter for applying an excitation signal to the vibrator.

A nebulization device of the above-mentioned type is described in International patent application publication WO 99/46126 (U.S. Pat. No. 6,460,980) in connection with the production of an inkjet print head.

However, various other applications of such a device may be made, particularly applications involving nebulization of liquids in the air, for purposes of humidifying or cooling the air, or for purifying diffusion, deodorizing, disinfecting products, perfumes, etc. as described for example in European published patent application EP 0 714 709 A or International patent application publication WO 00/78467. The present invention particularly relates to such applications.

FIG. 1 schematically represents the conventional structure of such a device. The device 10 comprises a nebulization head 20, an intermediate tank 21 containing a liquid 22 to be nebulized, a main tank 24 also containing liquid 22, a pipe 25 linking the tank 21 to the nebulization head 20, and a pipe 26 equipped with an electric pump 27, linking the tank 21 to the tank 24. The nebulization head 20, substantially horizontal, comprises a capillary tube 20-1 and an ejection nozzle 20-2 for ejecting the liquid. It generally has the form of a tubular needle, the inside diameter of which is less than one millimeter, the length of which is a few centimeters, the body of which forms the capillary tube 20-1, and the beveled, distal end of which forms the ejection nozzle 20-2. The nebulization head 20 is mechanically coupled to a vibrator, generally a resonating piezoelectric transducer 28, that is electrically powered by an AC signal Sv supplied by an excitation circuit EXCT. The excitation circuit EXCT is driven by a control circuit CNTCT that defines nebulization cycles whose duration varies according to the intended application.

In normal conditions of operation, the level of liquid in the intermediate tank 21 is at a height $H_1$ from the longitudinal axis of the nebulization head 20. As the tank 21 is subjected to atmospheric pressure Patm, the liquid 22 present in the pipe 25, at the inlet to the nebulization head 20, is subjected to the atmospheric pressure to which an overpressure Ph1 is added, equal to the hydrostatic pressure imposed by the liquid column of height $H_1$, where $Ph1=\rho \cdot g \cdot H_1$, $\rho$ being the density of the liquid and g the gravity.

When the excitation signal Sv is applied to the transducer 28, the nebulization head goes into resonance and an antinode appears at its end 20-2. Droplets 22-2 of liquid 22 are ejected in a direction substantially perpendicular to the plane of the beveled section of the nebulization head, forming a sort of mist of droplets or "nebulization jet." During the nebulization, the nebulization head 20 is supplied with liquid by capillarity and by gravity (effect of the hydrostatic overpressure). An air circulator, such as a fan (not represented), for circulating the air can be provided to increase the range of the nebulization jet.

When idle, when the nebulization head is not vibration driven, the liquid 22 is retained in the nebulization head by capillarity, and the hydrostatic pressure is offset by the appearance of a convex meniscus 22-1 of liquid 22 at the end of the nebulization head, due to the surface tension forces acting on the liquid. Above a critical overpressure threshold Sh1, the meniscus 22-1 breaks and the liquid 22 flows through the nebulization head.

It results from the above that the level of the liquid in the intermediate tank 21 must be precisely controlled, so that the hydrostatic pressure is maintained below the threshold Sh1, which is generally very low and on the order of 50 to 150 Pa.

Thus, the optimum height $H_1$ depends on the threshold Sh1 and the physico-chemical characteristics of the liquid, particularly the viscosity, the density, the surface tension forces, and on the inside diameter of the capillary tube of the nebulization head. This height is generally low, on the order of 5 to 15 mm with alcoholic or aqueous solutions and a nebulization head whose capillary tube has an inside diameter on the order of 0.6 mm. The height $H_1$ is kept substantially constant by the circuit CNTCT, that monitors the level of liquid with a level detector 23 arranged in the tank 21, and activates the pump 27 from time to time.

According to a known improvement represented in FIG. 2, wherein no pumps need be used, the device comprises an intermediate tank 21' linked to a main tank 24' by a pipe 26' according to the principle of communicating vessels. The tank 21' is subjected to atmospheric pressure Patm, while the tank 24' is hermetically closed and is subjected to a pressure P1 lower than atmospheric pressure, which prevents the tank 24' from being entirely emptied into the tank 21'. When hydrostatic equilibrium is achieved, the level of the liquid 22 in the tank 24' is above the level of the liquid in the tank 21'. When the level of liquid in the tank 21' becomes lower than the high level of the pipe 26', some air enters the tank 24' and some liquid is transferred into the tank 21'. An auxiliary pipe 27' can also be provided, so as to cause air to enter the upper part of the tank 24'. Thus, the height of liquid in the tank 21' is automatically regulated.

Despite this improvement, the nebulization device just described has various other disadvantages. In particular, the device is very sensitive to changes in trim that make the liquid move in the intermediate tank, as well as to other phenomena producing similar effects, for example vibrations transmitted by the external environment. Such changes in trim or vibrations can cause droplets to flow at the end of the nebulization head. Indeed, as the height $H_1$ is low, the movements of the surface of the liquid in the intermediate tank can lead to exceeding the critical threshold Sh1, thus breaking the meniscus 22-1 at the end of the nebulization head.

Another disadvantage of the conventional nebulization device is that its nebulization flow depends on the nature of the liquid that is nebulized. Flow rates that differ in a ratio ranging from 2 to 10 between liquids in aqueous solution and liquids in alcoholic solution, for the same nebulization head, can thus be observed. As an example, a nebulization head whose inside diameter is 0.6 mm and whose length is 27 mm, vibration driven at 200 kHz, enables flow rates to be obtained on the order of 1 to 3 grams per minute with liquids essentially made up of water (in which air treatment products are dissolved), but on the order of only 0.1 to 0.6 grams a minute with water-, ethyl alcohol- and dipropylene glycol-based solutions.

BRIEF SUMMARY OF THE INVENTION

The present invention aims to provide applications in which such changes in trim and such vibrations are frequent, such as the production of nebulizers on-board vehicles (trains, coaches, cars, etc.) or the production of portable nebulizers.

Thus, a first object of the present invention is to provide a nebulization device that is hardly sensitive to the changes in trim and other phenomena acting on the level of liquid in the tank.

Another object of the present invention is to considerably increase the nebulization flow of certain solutions, particularly alcoholic solutions.

More generally, one object of the present invention is to control the nebulization flow so as to be able to increase or decrease it without changing the nebulization head.

At least one object of the present invention is achieved by providing a nebulization device of the type described above, comprising a pressure regulator for applying to the liquid at the inlet to the nebulization head, during nebulization cycles, a pressure greater than a first pressure threshold above which the liquid flows through the nebulization head when the head is not vibration driven, and lower than a second pressure threshold above which the liquid flows through the nebulization head when the head is vibration driven.

According to one embodiment, an overpressure on the order of 1,000 Pa to 3,000 Pa is applied to the liquid at the inlet to the nebulization head, relative to the atmospheric pressure.

According to one embodiment, the pressure regulator for applying a pressure greater than the first threshold and lower than the second threshold comprises a liquid column whose height is equal to the sum of a height of liquid in the tank and a height between the bottom of the tank and the nebulization head.

According to one embodiment, the shape of the tank is such that the maximum height of the liquid in the tank is lower than one fifth of the height between the bottom of the tank and the nebulization head.

According to one embodiment, the pressure regulator for applying a pressure greater than the first threshold and lower than the second threshold comprises a device for pressurizing the liquid present in the liquid supply tank for supplying the nebulization head with liquid.

The tank for supplying the nebulization head with liquid is, for example, a deformable pocket that is squashed.

According to one embodiment, the device comprises a flow or pressure limiter arranged in the pipe between the tank and the nebulization head.

According to one embodiment, the pressure regulator for applying a pressure greater than the first threshold and lower than the second threshold comprise a valve arranged in the pipe between the tank and the nebulization head, and a valve controller to close the valve when the nebulization head is not vibration driven, and to open the valve when the nebulization head is vibration driven.

According to one embodiment, the flow or pressure limiter is integrated into the valve.

According to one embodiment, the device comprises an excitation controller for controlling the an exciter, so as to define nebulization cycles interrupted by halts during which the excitation signal is not applied to the vibrator, in which the excitation controller is arranged for chopping a nebulization cycle into a plurality of nebulization micro-cycles separated by micro-halts during which the excitation signal is not applied to the vibrator.

According to one embodiment, the excitation controller is arranged for defining nebulization cycles of a duration on the order of one hundred milliseconds to a few seconds, comprising nebulization micro-cycles of a duration on the order of one millisecond to a few tens of milliseconds.

According to one embodiment, the excitation controller is arranged for interrupting the nebulization cycles for halts of a duration greater than the duration of the nebulization cycles.

According to one embodiment, the valve controller does not close the valve during the micro-halts.

According to one embodiment, the valve controller is arranged for closing the valve before the end of a nebulization cycle, such that the nebulization head is emptied of all or part of the liquid it contains before stopping vibration.

According to one embodiment, the device comprises a switch for switching into an active standby mode comprising nebulization micro-cycles separated by halts of a duration at least 1,000 times greater than the duration of the micro-cycles, so as to cyclically wet the nebulization head.

According to one embodiment, the device comprises a main tank arranged below the tank for supplying the nebulization head with liquid, and a decanter for decanting liquid from the main tank to the tank for supplying the nebulization head with liquid.

According to one embodiment, the device is applied to the nebulization of a liquid in the air for purposes of humidifying or cooling the air, or for diffusing a purifying, deodorizing or disinfecting product, or a perfume, or a combination of these products.

According to one embodiment, the device comprises a ventilator for dispersing the nebulization jet.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 3 is a schematic representation of one embodiment of a nebulization device according to the present invention;

FIGS. 3A, 3B are diagrammatic representations of electric signals involved in the control of nebulization cycles according to previous practices;

FIGS. 4A, 4B, 4C are diagrammatic representations of electric signals involved in the control of nebulization cycles according to the present invention;

FIG. 5 is a schematic representation of the structure of control circuit (CNTCT) and excitation circuit (EXCT) represented in block form in FIG. 3; and FIGS. 6A, 6B are diagrammatic representations similar to FIGS. 4A, 4B, and FIG. 6C represents an electric signal involved in the control of nebulization cycles according to the present invention.

DETAILED DESCRIPTION OF THE INVENTION

First Aspect of the Present Invention

Figure 1:
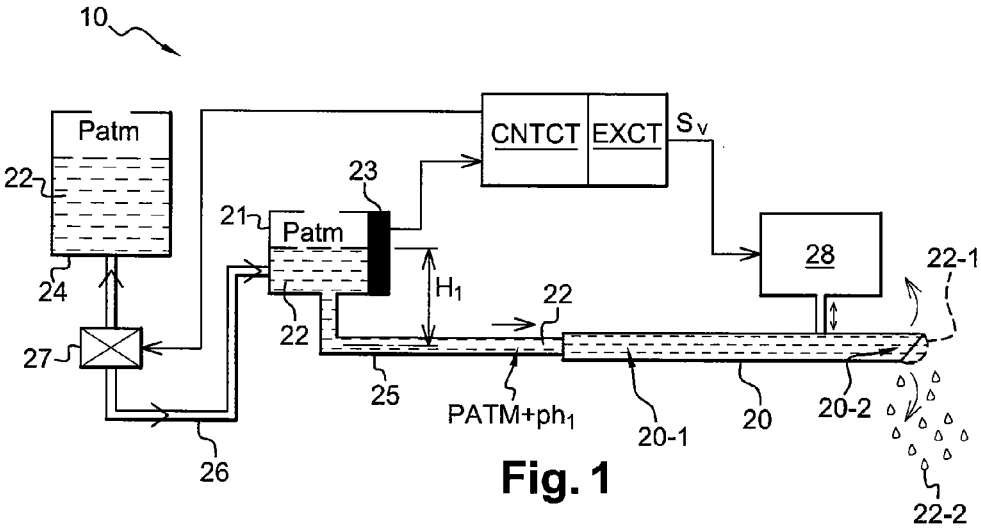
Fig. 1 PRIOR ART
FIG. 1 is a schematic representation of a conventional nebulization device.
Figure 2:
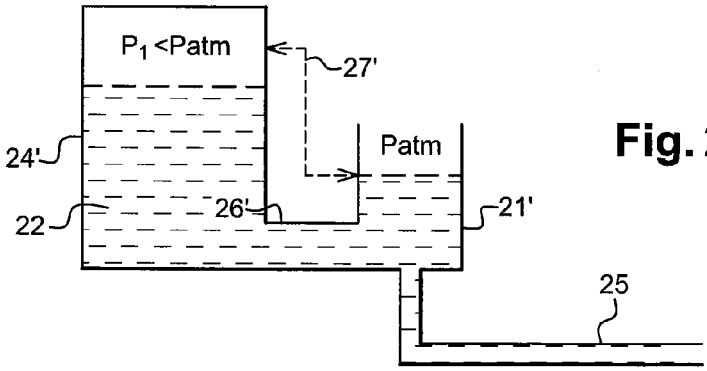
Fig. 2 PRIOR ART
FIG. 2 is a schematic representation of a known alternative embodiment of the device shown in FIG. 1.

A first aspect of the present invention is based on the observation according to which, when a nebulization head of the type described above is in operation, i.e., vibration driven, the liquid applied at the inlet to the nebulization head can be subjected to an overpressure clearly greater than the threshold Sh1 considered in previous practices as a limit not to be exceeded for preventing the liquid from flowing when the nebulization head is idle. On the contrary, an increase in the overpressure in the nebulization head advantageously increases the flow rate of nebulized liquid by facilitating the movement of the liquid in the capillary tube, which then works like a "pressure pipeline," provided that a second overpressure threshold Sh2 above which the liquid starts flowing from the nebulization head again is not exceeded. Now, the second overpressure threshold Sh2, above which the liquid flows while the nebulization head is vibration driven, is clearly higher than the first overpressure threshold Sh1. Experiments show that the threshold Sh2 is generally on the order of 1,000 to 3,000 Pa (i.e., about 1 to 3% of the atmospheric pressure) and depends on the dimensions of the nebulization head and on the characteristics of the liquid to be nebulized, while the first threshold is generally on the order of approximately 50 to 150 Pa, i.e., about 0.05 to 0.15% of the atmospheric pressure.

Thus, According to the Present Invention:

1) a first overpressure threshold Sh1 is defined that must not be exceeded when the nebulization head is idle;

2) a second overpressure threshold Sh2 is defined that must not be exceeded when the nebulization head is vibration driven;

3) when the nebulization head is vibration driven, the liquid in the nebulization head is subjected to an overpressure greater than the threshold Sh1 but lower than the threshold Sh2; and 4) when the nebulization head is idle, the liquid in the nebulization head is subjected to a zero overpressure or an overpressure at least lower than the threshold Sh1.

This first aspect of the present invention can be implemented in various ways. For example, the tank of liquid that supplies the nebulization head is overpressurized by a gas cartridge or a compact compressor when the nebulization head is vibration driven, and is then depressurized when the nebulization head is idle. The tank can also be overpressurized by heating the air or the gas situated above the liquid, or even by heating the entire tank so as to heat the air or the gas situated above the liquid, or by heating only a portion of the liquid. The tank of liquid can also be overpressurized by a mechanical system driven by a spring that imposes the sought overpressure on the liquid.

According to a first preferred embodiment, the liquid supply tank is a deformable pocket that is squashed by a plate 42*a* of a determined surface area, subjected to a bearing force exerted by a spring or any other means.

Furthermore, instead of depressurizing the tank of liquid when the nebulization head is idle, a valve can be arranged in the pipe linking the tank and the nebulization head. In this case, the overpressure can be constantly maintained in the tank, provided that the valve is closed when the nebulization head is idle.

FIG. 3 schematically represents a nebulization device 30 conforming to a second preferred embodiment, wherein the overpressure Sh2 is a hydrostatic pressure imposed by a liquid column whose height $H_2$ is greater than the conventional height $H_1$ described in the Background section above.

The device 30 comprises a conventional nebulization head 40, for example a tubular needle whose body 40-1 forms a capillary tube and whose distal end 40-2 is beveled so as to form an ejection nozzle. The nebulization head 40 is linked, through a pipe 41, to a single tank 42 that contains a liquid 43 to be nebulized. The tank 42 is subjected to the atmospheric pressure Patm and here forms both the main tank of the device and the supply tank for supplying the nebulization head. The nebulization head is mechanically coupled to a vibrator, such as a resonating piezoelectric transducer 44, excited by a signal Sv, for example a signal oscillating at 200 kHz. The excitation signal Sv is supplied by an excitation circuit EXCT driven by a control circuit CNTCT.

According to the present invention, the tank 42 is arranged so that the surface of the liquid 43 in the tank is at a height $H_2$ from the longitudinal axis of the nebulization head, and the height $H_2$ is chosen so that the liquid in the pipe 41, at the inlet to the nebulization head, is subjected, in relation to the atmospheric pressure Patm, to an overpressure Ph2 equal to $\rho \cdot g \cdot H_2$, such that:

$$Sh1<Ph2<Sh2$$

i.e., to a pressure Pr2, such that:

$$Patm+Sh1<Pr2<Patm+Sh2$$

where: Sh1 and Sh2 are the first and second overpressure thresholds described above;

Patm+Sh1 is a first pressure threshold corresponding to the first overpressure threshold Sh1;

Patm+Sh2 is a second pressure threshold corresponding to the second overpressure threshold Sh2;

Pr2 is the pressure of the liquid at the inlet to the nebulization head; and Ph2 is the overpressure applied in relation to the atmospheric pressure (or, generally speaking, the overpressure applied in relation to the pressure that exists at the outlet of the nebulization head, here the atmospheric pressure).

Again according to the present invention, a solenoid valve 45 is arranged in the pipe 41, between a first pipe section 41-1 linking the input of the solenoid valve 45 to the tank 42 and a second pipe section 41-2 linking the output of the solenoid valve 45 to the inlet to the nebulization head 40. The solenoid valve 45 is of "normally closed" type and is driven by an opening and closing signal Sg supplied by the control circuit CNTCT. The solenoid valve is closed (nebulization head isolated from the tank) when the nebulization head is idle and is opened by the circuit CNTCT when the nebulization head is vibration driven, subject to what will be described below in relation with an excitation mode of the transducer 44 comprising very short halts during which the solenoid valve is left open.

When idle, the overpressure of the liquid at the inlet to the nebulization head 40 is zero and the solenoid valve prevents the liquid contained in the tank from flowing, whether the device is switched off or in an active standby mode described below.

When the nebulization head 40 is vibration driven, the overpressure Ph2 applied to the liquid at the inlet to the nebulization head enables the nebulization flow rate for various liquids, such as aqueous or alcoholic solutions, to be significantly increased compared to the operation based solely on capillarity and on a hydrostatic overpressure below the threshold Sh1.

As another advantage, the overpressure Ph2 enables the exit velocity of the droplets to be increased, i.e., the kinetic energy of the nebulization jet, the effect of which is to increase the length and therefore the range of the nebulization jet. A nebulization jet with a length of 5 to 30 cm, or even more, can thus be obtained. In certain applications, this can enable an airflow not to be used (supplied for example by a fan) to carry and disperse the nebulization jet.

Depending on the extent of the overpressure Ph2, the viscosity of the liquid and the characteristics of the nebulization head, a flow limiter or a pressure limiter 46, schematically represented by the dotted lines in FIG. 3, can be arranged between the solenoid valve 45 and the inlet to the nebulization head 40.

In one embodiment, the flow or pressure limiter is integrated with the solenoid valve to form a solenoid valve-limiter block produced by microengineering techniques.

This may be a capillary-effect flow limiter that can be adjusted or parameterized, such as a capillary tube having an adjustable inside diameter, or a dynamic-control flow regulator in which the flow of the liquid causes a pressure loss that limits the flow rate. This may also be a pressure regulator, such as a needle and spring regulator, for example, that enables the overpressure at the inlet to the nebulization head to be maintained below the threshold SH2.

Such a flow or pressure limiter enables the flow in the pipe to be adjusted to a value corresponding to the nebulization capacity of the nebulization head, and enables a pipe to be provided, between the tank and the nebulization head, with an inside diameter that is not very small and an opening surface of the solenoid valve that is also not very small (and which would be too large in the absence of any flow or pressure limiter). Another advantage is that the overpressure is rapidly exerted on the liquid present in the nebulization head, as soon as the solenoid valve opens, without the flow rate exceeding the limit authorized by the nebulization head.

The pressurization of the liquid and the adjustment of the flow rate must be adapted to the nebulization capacity of the nebulization head 40. When these conditions are met, the nebulization flow rate obtained can be 10 to 20 times greater than the flow rate obtained with a conventional liquid supply. As an example, with a nebulization head having an inside diameter of 0.6 mm, vibration driven at 200 kHz, and an overpressure Ph2 of 1,200 Pa (i.e., about 1.2% of the atmospheric pressure), the nebulization flow rate can reach 50 mg/s instead of 0.5 mg/s by simple capillarity. The nebulized drops have a diameter on the order of 10 to 50 micrometers, or even more, in certain conditions of faster flow rate described below.

Another advantage of the present invention is to enable a nebulizer to be produced that tolerates the movements of the liquid in the tank (inclination or vibration of the tank), both when stopped and during operation. Indeed, it can be seen in FIG. 3 that the liquid height $H_2$ is equal to the sum of the height $h_1$ between the bottom of the tank 42 and the longitudinal axis of the nebulization head 40, and of the liquid height $h_2$ in the tank 42. Now, obtaining an overpressure between the thresholds Sh1 and Sh2, for example an overpressure on the order of 1,000 Pa to 3,000 Pa, implies having a height $H_2$ on the order of 100 to 300 mm with aqueous or alcoholic solutions. In these conditions, the shape of the tank can be chosen to be larger than it is high, so that the variations in the height $h_2$ due to the movements of the liquid and to the progressive consumption of the latter are negligible in relation to the height $h_1$ and, in any case, so that such variations do not lead the overpressure Ph2 to exceed the threshold Sh2. In practice, the height $h_2$ will preferably be lower than ⅕ of the height $h_1$.

It will be noted here that another advantage that results from providing a flow or pressure limiter is to be able to take to an even higher value, for example from 3,000 Pa to 5,000 Pa, the overpressure at the inlet to the pipe, upstream from the flow or pressure limiter, without however exceeding the overpressure threshold Sh2 at the inlet to the nebulization head, such that the overpressure variations, due, for example, to the variations in the height $h_2$ when the liquid moves in the tank, or to the expansion of the liquid in the tank when the latter is subjected to a temperature rise, are even more negligible in relation to the overpressure exerted on the liquid.

In one embodiment, the tank 42 is maintained by a height-adjustable fixing system, such as a rack-and-pinion system, for example, enabling the user to adjust the height $H_2$ according to the liquid used (as the densities can be different from one liquid to the next) by referring to adjustment abacuses for adjusting the height $h_1$ provided by the manufacturer. The adjustment of the height $h_1$ can also be controlled by microprocessor by providing an electrically-controlled rack, so as to be able to program a determined flow rate according to the intended application. In this case, height/flow rate abacuses are saved in the program memory of the microprocessor for each type of liquid. In one embodiment, the tank is equipped with a level detector having a mechanically- or electronically-adjustable detection threshold.

Finally, the present invention also enables the structure of the nebulizer to be simplified, as it is no longer essential to provide an intermediate tank for supplying the nebulization head. However, those skilled in the art will note that the present invention does not exclude providing an intermediate tank, particularly to enable liquid refill cartridges to be used, forming main tanks distinct from the liquid supply tank for supplying the nebulization head with liquid, for the sake of rationalizing the structure of the device, or even to place these tanks outside the very structure of the device. Thus, in one embodiment, an outside tank is arranged below the tank that supplies the nebulization head, and it is refilled with liquid by a pump or any other a decanter for decanting the liquid (for example by pressurizing the outside tank).

Second Aspect of the Present Invention

In applications involving nebulizing purifying, deodorizing, or disinfecting products, or perfumes, short nebulization cycles separated by long halts are generally defined. The duration of the nebulization cycles is generally of about one hundred milliseconds to a few hundred milliseconds, and rarely more than a few seconds. The duration of the halts is generally much longer than the duration of the cycles, often several tens of seconds to several tens of minutes.

For this purpose, the control circuit of a conventional nebulizer defines a template signal Se, represented in FIG. 3A, that is for example on 1 when the nebulization head must be vibration driven, for a time $t_1$ representing the duration of a nebulization cycle, and that is on 0 when the nebulization head must be idle, for a time $t_2$ representing the duration of a halt. Again in previous practices, and as shown in FIG. 3B, the excitation signal Sv is applied to the transducer 44 for the entire duration $t_1$ of the nebulization cycle, which therefore consists in a "continuous nebulization cycle."

The present invention is based here on the observation that providing very short nebulization periods separated by idle periods also very short, enables the average flow rate of nebulized liquid to be substantially increased, particularly the average nebulization flow rate of alcoholic solutions used to diffuse active substances, in particular various scents and perfumes. Thus, according to the present invention, a nebulization cycle is chopped into a plurality of very short nebulization periods, by applying to the transducer 44 pulse trains of the excitation signal Sv. For the sake of simplifying the terminology, the very short nebulization periods will be designated nebulization "micro-cycles" (or transducer excitation micro-cycles) and the corresponding very short idle periods will be designated "micro-halts".

So as to control the duration of the nebulization cycles and micro-cycles, the circuits CNTCT and EXCT of the device 30 according to the present invention (FIG. 3) use a template signal Se represented in FIG. 4A, and a sub-template signal Sse represented in FIG. 4B. The signal Se is on 1 during the time $t_3$ of a nebulization cycle and is on 0 during the time $t_4$ of a halt. The signal Sse is on 0 when the signal Se is on 0, and has a series of square waves on 1 when the signal Se is on 1. The square waves on 1 have a duration $t_5$ corresponding to the duration of the nebulization micro-cycles, and are separated by time intervals $t_6$ during which the signal Sse is on 0, corresponding to the micro-halts. The durations $t_5$ and $t_6$ can be identical and are, for example, of 50 milliseconds each. As shown in FIG. 4C, the excitation signal Sv is applied to the transducer 44 when the signal Sse is on 1, and is not applied to the transducer when the signal Sse is on 0. During each micro-halt of duration $t_6$, the liquid 43 continues to flow into the nebulization head such that, when the nebulization head is vibration driven again, the nebulization head is substantially "refilled" with liquid, up to the flow limit, and the quantity of liquid nebulized during the next nebulization micro-cycle is greater than the quantity that would be nebulized during the same time interval over a continuous nebulization cycle according to previous practices.

Thus, such a chopped nebulization is particularly advantageous with low surface tension liquids (ethanol, for example) or liquids having a higher viscosity than water (particularly heavy alcohols, such as dipropylene glycol) that propagate more slowly in the pipe.

Generally speaking, this nebulization method enables the efficiency of the nebulization process to be increased, both in terms of flow rate and decrease in size of the droplets.

Thus, for a given excitation time of the transducer 44, the quantity of liquid nebulized is higher when this excitation time is chopped into micro-cycles than when this excitation time is applied continuously to the nebulization head. Those skilled in the art will note that the average flow rate per unit of time is not necessarily increased, as the micro-halts extend the total time for nebulizing a given quantity of liquid. However, the average flow rate per "unit of excitation time" is increased, i.e. the quantity of liquid nebulized for a same excitation time of the transducer 44.

For a better understanding, it will be assumed that it is desired to implement the nebulization method according to the present invention so that the quantity of liquid nebulized during a chopped nebulization cycle of duration $t_3$, as represented in FIGS. 4A to 4C, is identical to the quantity of liquid nebulized during a conventional continuous nebulization cycle of duration $t_1$, as represented in FIGS. 3A, 3B. In this case, the ratio $t_3/t_1$ is given by the following relation:

$$t_3/t_1=[(t_5+t_6)/t_5]/(D2/D1)$$

in which the term "$(t_5+t_6)/t_5$" is the ratio between the period $t_5+t_6$ of the sub-template signal Sse and the duration $t_5$ of a micro-cycle, and represents the correction of the cycle time that would have to be made to take micro-halts into account if the average flow rate of liquid during the micro-cycles were equal to the average flow rate of liquid during the continuous nebulization cycle. The term D2/D1 is the ratio between the average flow rate D2 per "unit of excitation time" during a micro-cycle and the average flow rate D1 per "unit of excitation time" during a continuous nebulization cycle, and shows the advantage offered by the present invention.

Thus, for example, chopping a continuous nebulization cycle of duration $t_1$ into micro-cycles having a duty cycle of 1 ($t_5=t_6$) should, in principle, be offset by multiplying the duration of the cycle by 2, such that the duration $t_3$ of the chopped nebulization cycle should be equal to $2\cdot t_1$. However, as the flow rate of the nebulization head is improved, the term D2/D1 is greater than 1, for example equal to 1.5, and the duration $t_3$ of the chopped nebulization cycle is then equal to $(2/1.5)\cdot t_1$ so that a same quantity of liquid is nebulized.

Furthermore, assuming that it is desired for the quantity of liquid nebulized to be constant over long periods of time covering many nebulization cycles, the duration $t_4$ of the halts between the chopped nebulization cycles is reduced by a duration equal to $t_3-t_1$ in relation to the initial duration $t_2$, so that the periodicity of the cycles is kept constant ($t_1+t_2=t_3+t_4$).

Finally, the nebulization method according to the present invention enables the performance of the nebulization head to be improved, i.e., the quantity of liquid nebulized for a given quantity of electricity consumed, since the quantity of electricity consumed is proportional to the excitation time of the nebulization head. The present invention therefore enables the autonomy of the nebulization device to be improved when it is battery- or cell-powered.

Yet another advantage of the nebulization method according to the present invention is that the micro-halts enable the transducer 44 to cool down, such that the average temperature rise of the transducer 44 during the nebulization of a given quantity of liquid in chopped cycle is clearly lower than the temperature rise of the transducer for the nebulization of the same quantity of liquid in continuous cycle.

It will be understood by those skilled in the art that this second aspect of the present invention can be implemented independently of the first aspect of the present invention, i.e., without applying the overpressure Ph2 to the liquid at the inlet to the nebulization head. According to experimental observations, the average flow rate in chopped nebulization is increased by 20% to 50%, compared to an average flow rate in continuous nebulization, with water/alcohol combinations (such as water/ethanol or water/dipropylene glycol, for example) and in conventional conditions of supplying the nebulization head with liquid.

This second aspect of the present invention can however be advantageously combined with the first aspect of the present invention, so as to combine the advantages of each one. In this case, the solenoid valve 45 is left open during the micro-halts and is only closed again at the end of the chopped nebulization cycle, such that the liquid 43 can flow into the nebulization head during the micro-halts, the duration of which will be chosen to be even shorter due to the overpressure applied to the liquid.

FIG. 5 schematically shows an example of an embodiment of the control circuit CNTCT and of the excitation circuit EXCT.

The circuit CNTCT comprises a microprocessor MP, a program memory PMEM in which an application program is saved, a clock signal generator CKGEN, and a circuit ICT interfacing between the microprocessor MP and the outside world, to start or stop the nebulizer, for example. The generator CKGEN supplies the microprocessor with a clock signal $H_0$. The circuit ICT here comprises a manual on/off switch SW1 and, in accordance with a third aspect of the present invention, a manual switch SW2 used to switch the nebulizer into an active standby state, described below. The signals coming from the circuit ICT are applied to ports $P_1$, $P_2$ of the microprocessor. The latter also comprises a port $P_3$ that supplies the control signal Sg for controlling the solenoid valve 45, and a port $P_4$ supplying the template signal Se (FIG. 4A). Another port of the microprocessor can furthermore be dedicated to supplying a control signal for controlling a fan (not represented) provided for dispersing the nebulization jet.

The circuit EXCT comprises two frequency divider circuits Div1, Div2, AND logic gates with two inputs $A_1$, $A_2$, and a voltage adapter, here an operational amplifier AMP powered by voltages $V_1$ and $V_2$ corresponding to the specifications of the piezoelectric transducer 44 (FIG. 3). The frequency dividers Div1, Div2 are programmable by the microprocessor, both in output frequency and in duty cycle (the functional links with the microprocessor being schematized by arrows in dotted lines). The divider Div1 receives the clock signal $H_0$ and is programmed by the microprocessor for supplying a signal Hv oscillating at an excitation frequency for exciting the transducer 44, for example 200 kHz. The signal Hv is applied to an input of the gate $A_2$ and at input of the divider Div2. The latter is programmed by the microprocessor to supply a signal Hse formed by logic square waves the duration and duty cycle characteristics of which are identical to the characteristics desired for the sub-template signal Sse (FIG. 4B).

The signal Hse and the template signal Se are applied to the inputs of the gate $A_1$, the output of which supplies the sub-template signal Sse. Thus, the signal Sse copies the signal Hse when the signal Se is on 1, and is forced to 0 when the signal Se is on 0. The signal Sse is applied to the second input of the gate $A_2$, the output of which supplies a logic signal $Sv_1$. The signal $Sv_1$ is applied at input of the amplifier AMP the output of which supplies the signal Sv. The signal Sv is thus a signal oscillating at the frequency of the signal Hv, the envelope of which complies with the sub-template signal Sse, and the amplitude of which is equal to $V_1$ when the signal Hv is on 1 and is equal to $V_2$ when the signal Hv is on 0. Typically, the voltages $V_1$ and $V_2$ are +20V and −20V or +40V and 0V (ground) depending on the type of piezoelectric transducer used.

When the switch SW2 is switched into the active standby position, the microprocessor MP applies to the transducer 44 very short excitation micro-cycles, of 50 to 100 milliseconds for example, separated by very long halts, of 30 minutes for example. The advantage of such an active standby mode is that it enables the end of the nebulization head 40 (ejection nozzle 40-2, FIG. 3) to be periodically wet, without however consuming a large quantity of liquid and without using a lot of energy. It prevents the nebulization head from drying and enables the autonomy of the nebulizer to be preserved in terms of liquid consumption, but also in terms of electrical energy consumed, this point being important when the nebulizer is electrically powered by a battery or by electric cells.

FIGS. 6A, 6B and 6C show an aspect of the present invention relating to the control of the solenoid valve, and respectively represent the template signal Se, the sub-template signal Sse and the control signal Sg for controlling the solenoid valve, that is here set to 1 when the solenoid valve must be open. According to this aspect of the present invention, the control circuit CNTCT closes the solenoid valve (the signal Sg being set to 0) a lapse of time $dt_1$ before the end of a nebulization cycle as defined by the template signal Se, i.e., before the template signal Se changes to 0. The lapse of time $dt_1$ is, for example, on the order of 10 to 100 milliseconds, such that the pipe is no longer supplied with liquid while the last nebulization micro-cycle (signal Sse on 1) is performed. The effect of such an early closing is to empty the nebulization head at least partially and to prevent a spurious drop from being created when the excitation of the transducer is stopped, and can be provided independently of the second aspect of the present invention, i.e., whether or not the nebulization cycle is chopped.

Similarly, at the beginning of a nebulization cycle, the control circuit CNTCT can allow a lapse of time $dt_2$ to elapse before opening the solenoid valve. This enables the nebulization head to be taken to a steady vibratory regime before the liquid arrives in the nebulization head, so as to prevent the liquid from flowing at the beginning of the excitation.

It will be understood by those skilled in the art that various other alternative embodiments of the present invention are possible. Particularly, the duration of the nebulization micro-cycles and of the micro-halts can vary from one millisecond to several tens of milliseconds. These durations can be programmed by the microprocessor MP of the control circuit CNTCT according to abacuses saved by the manufacturer in the program memory PMEM, so as to suggest to the user that he specify the nature of the liquid introduced into the nebulizer and the desired nebulization flow rate. For this purpose, the interface circuit ICT can be more complex than the one described above and comprise electronic interface means rather than simple switches. This circuit can also be operated remotely, for example via a modem. Finally, the signals Se and Sse, described above as internal control signals, can be software variables if the duration of the cycles is counted by a subprogram.

Different applications of the present invention may be made, for example the production of a nebulization device for nebulizing liquids, as described in European published patent application EP 0 714 709, or the production of a device described in International patent application publication WO 00/78467, comprising a combination of several nebulization heads for emitting odor peaks.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A device for nebulizing a liquid, comprising:

a nebulization head comprising a capillary tube and an ejection nozzle for ejecting a liquid to be nebulized, the ejection nozzle having a distal beveled end to cause formation of droplets of the liquid to be nebulized;

a liquid supply tank for supplying the nebulization head with the liquid to be nebulized and linked to the nebulization head by a pipe;

a vibrator for vibration driving the nebulization head so that the ejection nozzle ejects droplets of liquid from the distal beveled end in a nebulization jet;

an exciter for applying an excitation signal to the vibrator; and a pressure regulator for applying pressure to the liquid at the inlet to the nebulization head, such that when the nebulization head is still, a first overpressure is applied, and during nebulization cycles when the nebulization head is vibration driven, a second overpressure is applied, wherein the pressure regulator comprises a valve arranged in the pipe between the liquid supply tank and the nebulization head and a controller for closing the valve when the nebulization head is not vibration driven and opening the valve when the nebulization head is vibration driven, and wherein the first overpressure is lower than a first overpressure threshold above which the liquid flows through the still nebulization head, and the second overpressure is greater than the first overpressure threshold and is lower than a second overpressure threshold above which the liquid flows through the vibration driven nebulization head instead of being nebulized.

2. The device according to claim 1, wherein the second overpressure is of an order of 1,000 Pa to 3,000 Pa relative to the atmospheric pressure.

3. The device according to claim 1, wherein the pressure regulator further comprises a liquid column whose height is equal to a sum of a height of liquid in the tank and of a height between the bottom of the tank and the nebulization head.

4. The device according to claim 3, wherein a shape of the tank is such that a maximum height of the liquid in the tank is lower than one fifth of a height between a bottom of the tank and the nebulization head.

5. The device according to claim 1, wherein the pressure regulator further comprises a pressurizer for pressurizing the liquid present in the liquid supply tank.

6. The device according to claim 5, wherein the tank is a deformable pocket that is squashable.

7. The device according to claim 1, further comprising a flow or pressure limiter arranged in the pipe between the tank and the nebulization head.

8. The device according to claim 7, wherein the flow or pressure limiter is integrated into the valve arranged in the pipe between the tank and the nebulization head.

9. The device according to claim 1, further comprising a controller for controlling the exciter, so as to define nebulization cycles interrupted by halts during which the excitation signal is not applied to the vibrator, wherein the controller is arranged for chopping a nebulization cycle into a plurality of nebulization micro-cycles separated by micro-halts during which the excitation signal is not applied to the vibrator.

10. The device according to claim 9, wherein the controller is arranged for defining nebulization cycles of a duration on an order of one hundred milliseconds to a few seconds, the nebulization cycles comprising nebulization micro-cycles of a duration on an order of one millisecond to a few tens of milliseconds.

11. The device according to claim 9, wherein the controller is arranged for interrupting the nebulization cycles for halts of a duration greater than the duration of the nebulization cycles.

12. The device according to claim 1, wherein the controller does not close the valve during micro-halts of a nebulization cycle.

13. The device according to claim 1, wherein the controller is arranged for closing the valve before the end of a nebulization cycle, such that the nebulization head is emptied of at least part of the liquid it contains before stopping vibrating.

14. A device for nebulizing a liquid, comprising:

a nebulization head comprising a capillary tube and an ejection nozzle for ejecting a liquid to be nebulized, the ejection nozzle having a distal beveled end to cause formation of droplets of the liquid to be nebulized;

a liquid supply tank for supplying the nebulization head with the liquid to be nebulized and linked to the nebulization head by a pipe;

a vibrator for vibration driving the nebulization head so that the ejection nozzle ejects droplets of liquid from the distal beveled end in a nebulization jet;

a switch for switching into an active standby mode comprising nebulization micro-cycles separated by halts of a duration at least 1,000 times greater than a duration of the micro-cycles, so as to cyclically wet the nebulization head;

an exciter for applying an excitation signal to the vibrator; and a pressure regulator for applying pressure to the liquid at the inlet to the nebulization head, such that when the nebulization head is still, a first overpressure is applied, and during nebulization cycles when the nebulization head is vibration driven, a second overpressure is applied, wherein the first overpressure is lower than a first overpressure threshold above which the liquid flows through the still nebulization head, and the second overpressure is greater than the first overpressure threshold and is lower than a second overpressure threshold above which the liquid flows through the vibration driven nebulization head instead of being nebulized.

15. The device according to claim 1, wherein the device is arranged for nebulizing a liquid in air for purposes of humidifying or cooling the air, or for diffusing into the air at least one of a purifying product, a deodorizing product, a disinfecting product, and a perfume.

* * * * *